US009640320B2

(12) United States Patent
Watanabe et al.

(10) Patent No.: US 9,640,320 B2
(45) Date of Patent: May 2, 2017

(54) METHOD OF PRODUCING GRAIN-ORIENTED ELECTRICAL STEEL SHEET

(75) Inventors: Makoto Watanabe, Tokyo (JP); Yukihiro Shingaki, Tokyo (JP); Toshito Takamiya, Tokyo (JP); Tomoyuki Okubo, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 0 days.

(21) Appl. No.: 14/235,652

(22) PCT Filed: Aug. 8, 2012

(86) PCT No.: PCT/JP2012/070238

§ 371 (c)(1),
(2), (4) Date: Jan. 28, 2014

(87) PCT Pub. No.: WO2013/024772

PCT Pub. Date: Feb. 21, 2013

(65) Prior Publication Data

US 2014/0202599 A1 Jul. 24, 2014

(30) Foreign Application Priority Data

Aug. 12, 2011 (JP) ..... 2011-176663
Jul. 20, 2012 (JP) ..... 2012-161136

(51) Int. Cl.
*H01F 1/04* (2006.01)
*C21D 6/00* (2006.01)
(Continued)

(52) U.S. Cl.
CPC ..... *H01F 41/04* (2013.01); *C21D 6/00* (2013.01); *C21D 8/12* (2013.01); *C21D 8/1272* (2013.01);
(Continued)

(58) Field of Classification Search
CPC .. H01F 41/04; H01F 1/16; C21D 6/00; C21D 8/1272; C21D 8/1283; C21D 8/12;
(Continued)

(56) References Cited

U.S. PATENT DOCUMENTS 4,504,957 A * 3/1985 McClelland et al. ..... 373/130
4,898,626 A 2/1990 Shoen
(Continued)

FOREIGN PATENT DOCUMENTS

CN 1708594 12/2005
CN 101778964 7/2010
(Continued)

OTHER PUBLICATIONS

Omura et al., JP Pub. No. 2010-236013 (machine translation).*
(Continued)

*Primary Examiner* — Jessee Roe
*Assistant Examiner* — John Hevey
(74) *Attorney, Agent, or Firm* — RatnerPrestia

(57) ABSTRACT

In a method of producing a grain-oriented electrical steel sheet by subjecting a coil for grain-oriented electrical steel sheet after cold rolling to a primary recrystallization annealing, applying an annealing separator thereon, and conducting final annealing, rapid heating is conducted at a rate of not less than 80° C./sec from 500° C. to 700° C. in the course of heating for the primary recrystallization annealing, and a temperature keeping treatment is conducted for 2 to 100 hours from 700° C. to 1000° C. in the course of heating for the final annealing, and further, the final annealing is preferably conducted by laying a thermal insulation material on an upper surface of a coil supporting stand in an annealing furnace used for the final annealing concentrically from the
(Continued)

outer periphery of the coil supporting stand and over an area of not less than 20% of the radius of the coil supporting stand.

4 Claims, 3 Drawing Sheets

(51) Int. Cl.

| | |
|---|---|
| ***C21D 8/12*** | (2006.01) |
| ***C22C 38/00*** | (2006.01) |
| ***H01F 41/04*** | (2006.01) |
| ***C21D 9/46*** | (2006.01) |
| ***H01F 1/16*** | (2006.01) |
| ***C22C 38/02*** | (2006.01) |
| ***C22C 38/04*** | (2006.01) |
| *C22C 38/60* | (2006.01) |

(52) U.S. Cl.
CPC ..... *C21D 8/1283* (2013.01); *C21D 9/46* (2013.01); *C22C 38/001* (2013.01); *C22C 38/02* (2013.01); *C22C 38/04* (2013.01); *H01F 1/16* (2013.01); *C21D 8/1233* (2013.01); *C21D 8/1266* (2013.01); *C21D 2201/05* (2013.01); *C22C 38/00* (2013.01); *C22C 38/60* (2013.01)

(58) Field of Classification Search
CPC ..... C21D 8/1233; C21D 8/1266; C21D 9/46; C21D 2201/05; C22C 38/00; C22C 38/02; C22C 38/04; C22C 38/001; C22C 38/60
USPC ..... 148/579, 601
See application file for complete search history.

(56) References Cited

U.S. PATENT DOCUMENTS

| | | | | |
|---|---|---|---|---|
| 5,833,768 | A | 11/1998 | Kosuge | |
| 7,291,230 | B2 * | 11/2007 | Homma | C22C 38/02 148/111 |
| 7,465,361 | B2 | 12/2008 | Terashima | |
| 8,771,795 | B2 | 7/2014 | Muraki | |
| 2002/0038678 | A1 | 4/2002 | Ushigami | |
| 2010/0005481 | A1 | 1/2010 | Lewis | |
| 2010/0055481 | A1 | 3/2010 | Kubo | |
| 2011/0067786 | A1 * | 3/2011 | Takashima | C21D 6/00 148/537 |
| 2011/0155285 | A1 * | 6/2011 | Kumano | C21D 6/008 148/208 |
| 2014/0251514 | A1 * | 9/2014 | Watanabe et al. | 148/645 |
| 2014/0338794 | A1 * | 11/2014 | Shingaki et al. | 148/111 |
| 2015/0007908 | A1 * | 1/2015 | Watanabe et al. | 148/111 |

FOREIGN PATENT DOCUMENTS

| | | | |
|---|---|---|---|
| JP | 59-43818 | A | 3/1984 |
| JP | 5-51643 | A | 3/1993 |
| JP | 06128646 | | 5/1994 |
| JP | 2006-257486 | A | 9/2006 |
| JP | 2006-274343 | A | 10/2006 |
| JP | 2010-236013 | A | 10/2010 |
| JP | 2011-6738 | A | 1/2011 |
| JP | 2011-174138 | A | 9/2011 |
| JP | 2012-126989 | A | 7/2012 |
| KR | 20120074030 | | 7/2012 |

OTHER PUBLICATIONS

International Search Report mailed Sep. 11, 2012 in International Application No. PCT/JP2012/070238.
International Preliminary Report on Patentability and Written Opinion dated Feb. 18, 2014, application No. PCT/JP2012/070238.
European Search Report mailed Jun. 5, 2015 for European Application No. 12824506.5.
Korean Office Action issued May 26, 2015 for Korean Application No. 2014-7000584, with English translation.
European Office Action for Application No. 12824506.5, dated Jun. 14, 2016.
Final Office Action dated Nov. 20, 2015 for U.S. Appl. No. 14/431,577.
Japanese Office Action dated Oct. 28, 2015 for Japanese Application No. 2012-161136 with translation.
Korean Office Action issued Nov. 26, 2015 for Korean Application No. 2014-7000584 with English translation.
Office Action for Application No. 2014-7000584 dated Jan. 14, 2016, with partial translation as Concise Statement of Relevance.
Second Chinese Office Action dated Apr. 22, 2015 for Chinese Application No. 201280036630.3, with English translation.
Final Office Action mailed Sep. 8, 2016 for U.S. Appl. No. 14/431,577, 8 pages.
Non-Final Office Action mailed Dec. 15, 2016 for U.S. Appl. No. 14/344,805, 18 pages.

* cited by examiner

METHOD OF PRODUCING GRAIN-ORIENTED ELECTRICAL STEEL SHEET

CROSS REFERENCE TO RELATED APPLICATIONS

This is the U.S. National Phase application of PCT/JP2012/070238, filed Aug. 8, 2012, which claims priority to Japanese Patent Application No. 2011-176663, filed Aug. 12, 2011, and Japanese Patent Application No. 2012-161136, filed Jul. 20, 2012, the disclosures of each of these applications being incorporated herein by reference in their entireties for all purposes.

FIELD OF THE INVENTION

This invention relates to a method of producing a grain-oriented electrical steel sheet, and more particularly to a method of producing a grain-oriented electrical steel sheet capable of significantly reducing defects of coil shape generated during final annealing.

BACKGROUND OF THE INVENTION

A grain-oriented electrical steel sheet is a soft magnetic material mainly used as a core material for transformers or the like, and is required to have excellent magnetic properties, particularly low iron loss. In the production of the grain-oriented electrical steel sheet, therefore, the steel sheet is subjected to a final annealing by heating to a high temperature of approximately 1000° C. to cause secondary recrystallization to thereby highly orient crystal grains in the steel sheet to Goss orientation ({110}<001> orientation). Moreover, in the final annealing, it is common to conduct a purifying treatment by heating to approximately 1200° C. to remove impurities, following the secondary recrystallization. Since the final annealing requires a long time of about 10 days at maximum, it is common to anneal the steel sheet with a coiled state in a batch type annealing furnace.

However, when the final annealing is conducted at such a high temperature over the long time, the coil itself is creep-deformed by its own weight or thermal expansion is restricted to cause a variety of shape defects, resulting in the decrease of the product yield. In the worst case, the steel sheet can no longer be threaded into a flattening annealing facility after the final annealing.

As a technique for solving such problems, various methods have been studied.

For example, Patent Document 1 proposes a technique wherein a thermal insulation material is lined to an inner side wall portion of an inner cover covering the coil in the final annealing to reduce wrinkle-like shape defects generated on the outer winding portion of the coil. Also, Patent Document 2 proposes a technique wherein an outer peripheral end face portion of a coil supporting stand in a final annealing furnace is covered with a thermal insulation material to prevent side distortion defects generated on the lower side portion of the coil contacting with the coil supporting stand. Further, Patent Document 3 proposes a technique wherein a metal ring is inserted into a central space of the coil placed at an upended state to prevent an inner winding portion of the coil from collapsing into the central space side.

PATENT DOCUMENTS

Patent Document 1: JP-A-2006-257486
Patent Document 2: JP-A-H05-051643
Patent Document 3: JP-A-2006-274343

SUMMARY OF THE INVENTION

By the applications of the above conventional techniques are improved the coil shapes after the final annealing to some extent and the yield is increased. However, a particular shape defect can be eliminated by the above methods, while other shape defects may be caused adversely, so that until now it is difficult to say that sufficient improving effect is obtained.

For example, in the method of Patent Document 1, overheating on the outer peripheral surface of the coil is resolved to reduce the wrinkle-like shape defect. However, since heat to the coil is input only from the upper surface portion of the coil, the temperature distribution on the upper surface portion and internal portion of the coil becomes non-uniform, and hence the edge portion tends to be expanded in an outer direction of the outer periphery to increase edge wave defect.

In the method of Patent Document 2, by thermally insulating the outer peripheral end face portion of the coil supporting stand is hardly generated the side distortion defect of the lower side face portion of the coil contacting with the coil supporting stand, but the effect is not sufficient by itself. Moreover, the thermal insulation material may be locally exfoliated by thermal expansion of the coil supporting stand during the annealing to rather increase the side distortion defect at a portion of the coil corresponding to the exfoliated portion.

In the method of Patent Document 3, it is necessary to increase the thickness of the metal ring in order to enhance the strength of the ring for prevention from the collapsing. However, the mass of the ring is increased, so that there is a problem that the handling becomes difficult or the side distortion defect is rather increased.

The invention is made in view of the above problems inherent to the conventional techniques, and is intended to reduce shape defects such as side distortion defect of the side face portion of the coil contacting with the coil supporting stand, wrinkle-like defect generated on the outer winding portion of the coil, and edge wave defect in the edge portion of the coil expanding in the outer direction of the outer periphery to thereby largely increase the product yield.

In order to solve the above problems, the inventors have made various studies on the analysis of causes generating the shape defects and the effective counter measures thereof. As a result, it has been found that the above "wrinkle-like shape defect" and "edge wave defect" can be largely improved not only by rapid heating in the course of the heating for primary recrystallization annealing but also by conducting a temperature keeping treatment in the course of the heating for final annealing, and the "side distortion defect" can be largely improved by laying a thermal insulation material on the upper surface of the coil supporting stand in the final annealing furnace, and as a result, the invention has been accomplished.

That is, the invention proposes an embodiment of a method of producing a grain-oriented electrical steel sheet by subjecting a coil for grain-oriented electrical steel sheet after cold rolling to a primary recrystallization annealing, applying an annealing separator thereon, and conducting final annealing, characterized in that rapid heating is conducted at a rate of not less than 80° C./sec from 500° C. to 700° C. in the heating for the primary recrystallization annealing, and a temperature keeping treatment is conducted for 2 to 100 hours from 700° C. to 1000° C. in the course of the heating for the final annealing.

The method of producing a grain-oriented electrical steel sheet according to an embodiment of the invention is characterized in that the final annealing is conducted by laying a thermal insulation material on an upper surface of a coil supporting stand in an annealing furnace used for the final annealing concentrically from the outer periphery of the coil supporting stand and over an area of not less than 20% of the radius of the coil supporting stand.

Also, the method of producing a grain-oriented electrical steel sheet according to an embodiment of the invention is characterized in that the rapid heating in the primary recrystallization annealing is conducted by another heat treatment preceding the primary recrystallization annealing.

According to the invention, it is possible to effectively reduce the shape defects such as the side distortion defect resulting from the contact with the coil supporting stand, the wrinkle-like shape defect generated on the outer winding portion of the coil, the edge wave defect due to the collapsing of the coil edge portion in the outer direction of the outer periphery and the like, which come into problems when the grain-oriented electrical steel sheet is produced in a batch type final annealing furnace, and as a result, the product yield can be increased largely.

DETAILED DESCRIPTION OF EMBODIMENTS OF THE INVENTION

The inventors have made various experiments and studied on the solution for resolving various shape defects generated in the final annealing. Consequently, we have newly found that the shape defects can be largely reduced by rapid heating over a given temperature range in the course of the heating for the primary recrystallization annealing and conducting a temperature keeping treatment for keeping a given temperature for a given time in the course of the heating for the final annealing. In addition, it has been found that the shape defects can be further reduced by laying the thermal insulation material on the upper surface of the coil supporting stand in the final annealing furnace. The experiments for obtaining the above findings will be described below.

A steel slab for a grain-oriented electrical steel sheet comprising C: 0.07 mass %, Si: 3.3 mass %, Mn: 0.06 mass %, Al: 0.025 mass %, N: 0.008 mass %, Se: 0.02 mass %, Sb: 0.03 mass % and the remainder being substantively Fe is hot rolled and cold rolled according to the common procedures to obtain a cold rolled sheet with a final thickness of 0.23 mm, which is then subjected to primary recrystallization annealing combined with decarburization annealing. The primary recrystallization annealing is conducted under a condition that the heating is conducted by varying an average heating rate within a range of 10 to 300° C./sec from 500° C. to 700° C. in the heating process and then a soaking treatment of 800° C.×120 sec for decarburization purpose combined is conducted under a wet hydrogen-nitrogen mixed atmosphere.

Then, the steel sheet after the primary recrystallization annealing is coated on its surface with an annealing separator composed mainly of MgO, dried, wounded in a coil, and placed on an upper surface of a coil supporting stand in a batch type annealing furnace at an upended state, which is subjected to final annealing. In the final annealing, the coil is placed on the upper surface of the coil supporting stand without laying a thermal insulation material on the upper surface of the coil supporting stand. The annealing cycle is conducted under conditions that a temperature keeping treatment at 800° C. in the course of the heating is conducted by varying the keeping time within a range of 0 to 150 hours and the temperature is raised up to 1180° C. at a rate of 20° C./hr and then kept for 10 hours. The steel sheet after the final annealing is pickled with phosphoric acid to remove the unreacted annealing separator, coated with an insulation coating, and subjected to a flattening annealing for the purpose of baking and shape correction at 800° C. for 20 seconds to obtain a product coil.

In the flattening annealing, the length of shape defect generated in the final annealing is measured by visually observing the shape of the steel sheet traveling through the equipment to determine a shape defect rate (=(length of shape defect/full length of coil)×100(%)).

Figure 1:
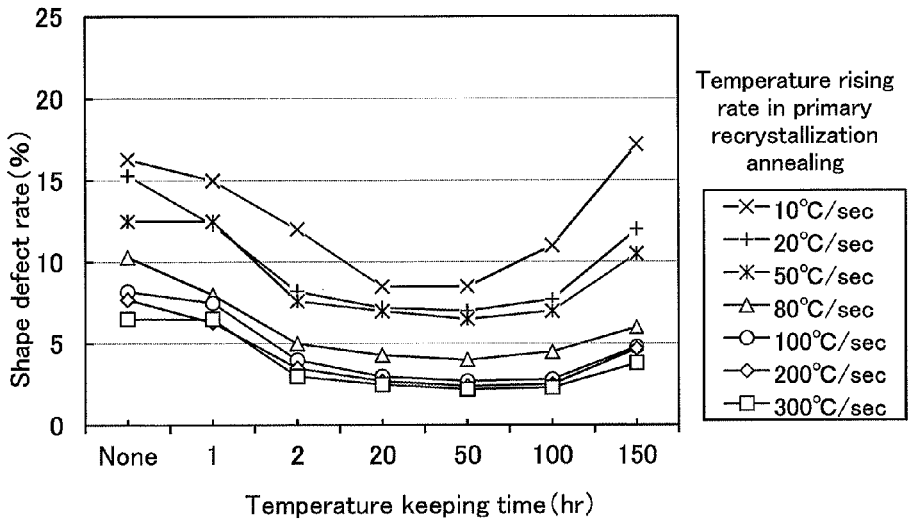
FIG. 1 is a graph showing an influence of a heating rate in primary recrystallization annealing and 800° C. keeping time in final annealing on shape defect generating rate.

The results are shown in FIG. 1. As seen from FIG. 1, the shape defect rate can be reduced to not more than 5% by making the heating rate in the primary recrystallization annealing to not less than 80° C./sec and making the keeping time at 800° C. in the final annealing to not less than 2 hours, while when the keeping time exceeds 100 hours, the shape defect rate increases inversely.

Figure 2:
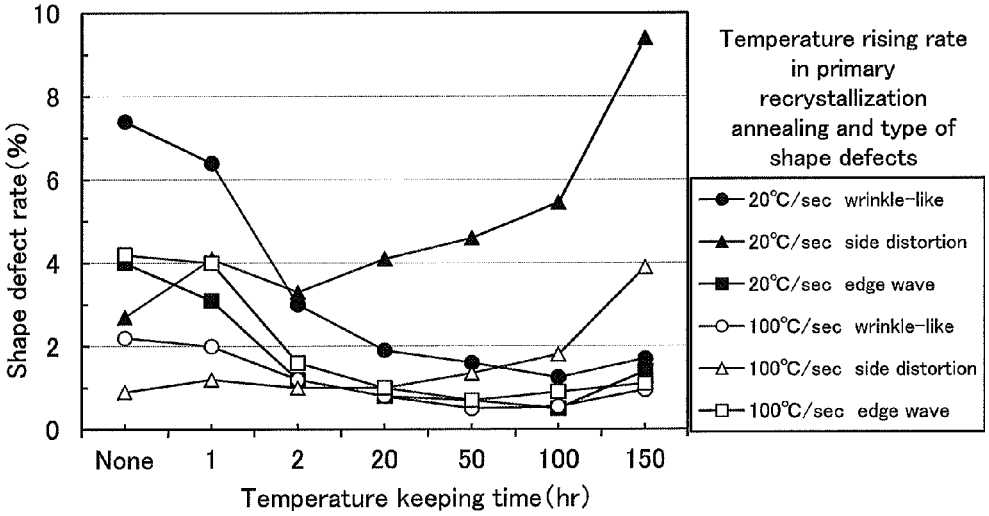
FIG. 2 is a graph showing an influence of a heating rate in primary recrystallization annealing and 800° C. keeping time in final annealing on a generating rate of each of shape defects.

Furthermore, FIG. 2 shows the generating rates of shape defects in relation to the data with the heating rates of 20° C./sec and 100° C./sec shown in FIG. 1. In this figure, "side distortion" means a side distortion defect generated on the lower side surface portion of the coil, and "wrinkle-like" means a wrinkle-like shape defect generated on the outer winding portion of the coil, and "edge wave" means an edge wave defect of the coil edge portion expanding in the outer direction of outer periphery.

As seen from FIG. 2, the wrinkle-like shape defect generated on the outer winding portion of the coil shows a high generating rate without conducting the temperature keeping treatment in the course of the heating for the final annealing, which is reduced by extending the keeping time. Also, the edge wave defect generated on the outer winding portion of the coil is improved by extending the keeping time like the wrinkle-like shape defect. However, it can be seen that when the keeping time is extended, the side distortion defect generated on the lower side surface portion of the coil is rather increased. From these results, it can be seen that the improvement of the shape defect rate by extending the keeping time in the final annealing in FIG. 1 is led by the improvements of the wrinkle-like shape defect and the edge wave defect. Moreover, the side distortion defect tends to be improved by rapid heating in the primary recrystallization annealing, but there is still a room for improvement.

From the above results, it is necessary to reduce side distortion defects in order to further reduce the shape defect rate to increase the yield. To that end, the inventors have further conducted the following experiment.

Figure 3:
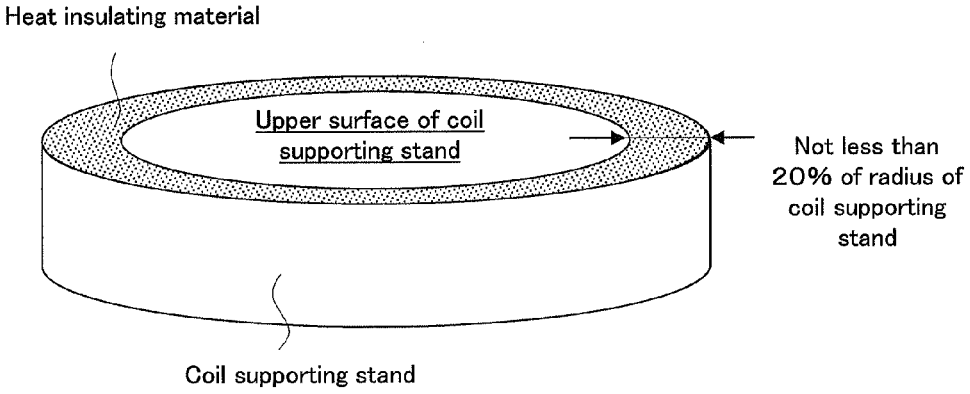
FIG. 3 is a view illustrating a thermal insulation material laid on an upper surface of a coil supporting stand.

A steel slab having the same chemical composition as in the above experiment is processed to obtain a cold rolled sheet with a final thickness under the same conditions as the above experiment. Then, the cold rolled sheet is subjected to primary recrystallization annealing combined with decarburization by heating from 500° C. to 700° C. at an average heating rate of 100° C./sec and then soaking at 800° C. for 120 seconds under a wet hydrogen-nitrogen mixed atmosphere. Thereafter, the sheet is coated with an annealing separator composed mainly of MgO, dried, wound in a coil, and placed on the coil supporting stand in the final annealing furnace at an upended state. In this case, a thermal insulation material is laid on an upper surface of the coil supporting stand concentrically from the outer periphery of the coil supporting stand (centrally perforated disk form) and by varying an area within a range of 0-60% with respect to the radius of the coil supporting stand as shown in FIG. 3.

Subsequently, the sheet is subjected to final annealing by varying a keeping time in the temperature keeping treatment at 800° C. of the heating process within a range of from 0 to 150 hours, raising the temperature at a rate of 200° C./hr up to 1180° C. and then keeping for 10 hours like the above experiment, pickled with phosphoric acid to remove the unreacted annealing separator, coated with an insulation coating, and then subjected to a flattening annealing for the purpose of baking and shape correction at 800° C. for 20 seconds to obtain a product coil.

In the flattening annealing, the length of shape defect generated in the final annealing is measured by visually observing the shape of the steel sheet traveling through the equipment to determine the shape defect rate. The results are shown in FIG. 4.

Figure 4:
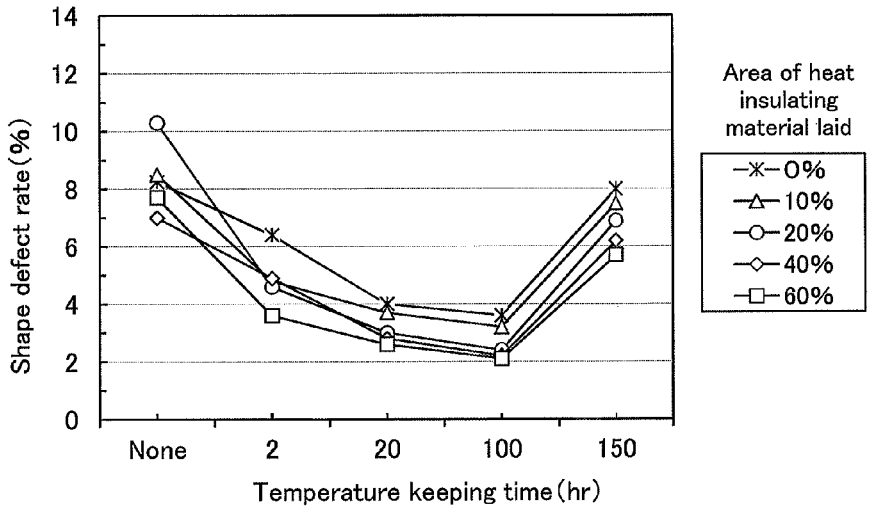
FIG. 4 is a graph showing an influence of an area of a thermal insulation material laid on an upper surface of a coil supporting stand in a final annealing furnace and 800° C. keeping time in final annealing on shape defect generating rate.
Figure 5:
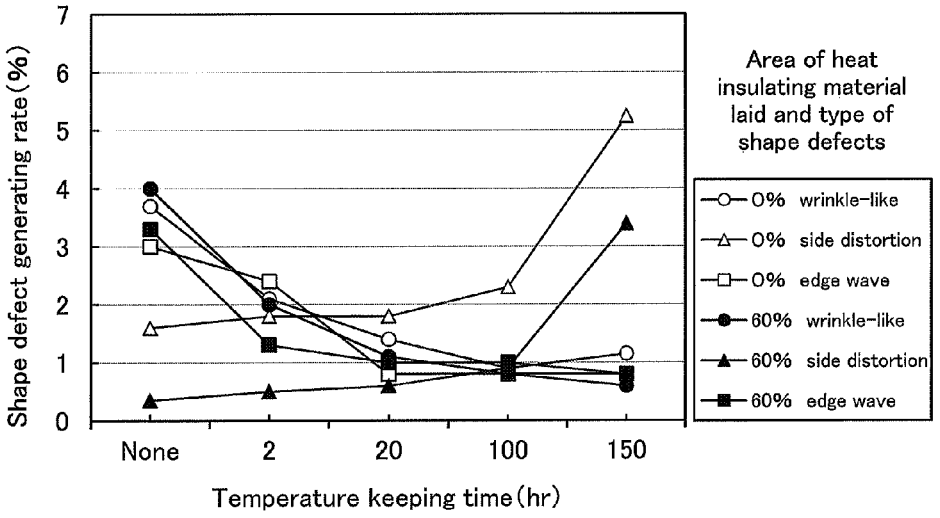
FIG. 5 is a graph showing an influence of an area of a thermal insulation material laid on an upper surface of a coil supporting stand in a final annealing furnace and 800° C. keeping time in final annealing on a generating rate of each of shape defects.

As seen from FIG. 4, the shape defect rate can be largely reduced when the thermal insulation material is laid on the upper surface of the coil supporting stand in the final annealing furnace concentrically from the outer periphery of the coil supporting stand and over an area of not less than 20% with respect to the radius of the coil supporting stand and when the temperature keeping treatment is conducted at 800° C. for 2-100 hours in the course of the heating for the final annealing. Furthermore, FIG. 5 shows the results measured on the shape defect generating rate of each of the shape defects when the area of the thermal insulation material laid is 0% (no laying) or 60% with respect to the radius of the coil supporting stand. As seen from this figure, the side distortion defect is considerably improved by laying the thermal insulation material.

Regarding the reason why the shape defects can be largely improved by combining the rapid heating in the course of the heating for the primary recrystallization annealing, the temperature keeping treatment in the heating process for the final annealing and the laying of the thermal insulation material on the coil supporting stand in the final annealing furnace as described above, the inventors consider as follows.

Firstly, as the reasons generating various shape defects are analyzed, the generation of the wrinkle-like shape defect in the outer winding portion of the coil is considered due to the fact that if temperature variation resulting from the heating process is caused in the coil, the thermal shrinkage in the cooling of the final annealing is partially interrupted in combination with thickness variation of the annealing separator to cause creep deformation in this portion.

Also, the generation of the edge wave defect expanding the upper side edge portion of the coil placed at the upended state in the outer direction of the outer periphery is considered due to the fact that when the coil is thermally expanded during the heating in the final annealing, internal oxide film produced in the course of forsterite formation exfoliates in the upper side edge portion of the coil and drops into interspaces between the coiled sheets, and when the coil is thermally shrunk in subsequent cooling, the exfoliated powdery internal oxide film interrupts the shrinkage of the coil.

Further, the side distortion defect generated on the side face portion of the coil is considered due to the fact that although the coil is thermally expanded in the heating of the final annealing to expand the side face portion of the coil in the outer direction of the outer periphery, the thermal expansion is interrupted by friction between the coil supporting stand and the side face portion of the coil to cause the deformation of the side face portion of the coil.

Moreover, as described in "BACKGROUND ART", the conventional techniques as a single improvement method have a problem that although a particular shape defect is resolved, different shape defects are generated and hence, the shape defects cannot be resolved as a whole.

On the other hand, as seen from the results of the above experiments performed by the inventors, there is a tendency that when the temperature keeping treatment is conducted at a given temperature in the course of the heating of the final annealing, the wrinkle-like shape defect and the edge wave defect are improved, but the side distortion defect is deteriorated instead.

The reason why the wrinkle-like shape defect is improved by the temperature keeping treatment is considered due to the fact that not only the temperature distribution in the coil but also the degree of sintering of the annealing separator are uniformized by the temperature keeping treatment and hence there is no change in bulk density between the coiled layers interrupting the shrinking in the cooling and the shape is improved.

Also, the reason why the edge wave defect is improved by the temperature keeping treatment is considered due to the fact that hydration water discharged from MgO in the annealing separator is sufficiently removed during keeping at a given temperature for a given time to eliminate the above-described exfoliation of the internal oxide film in the upper portion of the coil.

Further, the reason why the side distortion defect is rather deteriorated by the temperature keeping treatment is considered due to the fact that the increase in the thermal load applied to the coil by keeping at a higher temperature leads to the increased creep deformation.

The wrinkle-like shape defect and the side distortion defect can be reduced by rapid heating in the course of the heating for the primary recrystallization annealing.

Because, when the rapid heating is conducted in the course of the heating for the primary recrystallization annealing, Goss intensity in the primary recrystallized texture is enhanced to lower the secondary recrystallization temperature in the final annealing. As a result, the high-temperature strength of the steel sheet is increased and the creep deformation is hardly generated, and the side distortion defect is improved.

Also, when the rapid heating is conducted in the course of the heating for the primary recrystallization annealing, the form of the internal oxide layer formed beneath the surface layer of the steel sheet is changed to suppress the sintering of MgO in the final annealing. As a result, the grain size of MgO remains fine and the bulk density is not increased, so that an effect of mitigating deformation stress is produced in the steel sheet to improve the wrinkle-like shape defect.

Moreover, the change in the form of the internal oxide layer causes the exfoliation of the internal oxide film in the upper side face portion of the coil during the final annealing, and therefore the rapid heating promotes the edge wave defect. However, the adverse effect thereof can be minimized by the effect of uniformizing the temperature in the coil by the temperature keeping treatment in the course of the heating for the final annealing or the effect of promoting the discharge of hydration water from MgO.

Furthermore, the reason why the side distortion defect is improved by laying the thermal insulation material on the coil supporting stand in the final annealing furnace is considered due to the fact that thermal deformation of the outer peripheral portion of the coil supporting stand warping toward the upper surface side can be prevented by laying the thermal insulation material to ease friction between the coil and coil supporting stand. That is, when the thermal insulation material is not laid, heat on the upper portion of the coil supporting stand is taken by the coil to make the temperature of the lower portion of the coil higher than that of the upper portion thereof, so that the coil supporting stand is deformed so as to warp toward the upper surface side due to the difference of thermal expansion between the upper portion and lower portion of the coil supporting stand. In this case, when the thermal insulation material is laid on the outer peripheral portion of the coil supporting stand, heat absorption by the coil can be suppressed to prevent the deformation of the coil supporting stand. Also, even if some warping is caused in the coil supporting stand, the thermal insulation material serves as a buffer and can prevent the deformation of the coil more effectively.

Moreover, when the thermal insulation material is laid on the coil supporting stand, heat input from the lower side surface of the coil is suppressed to increase heat input from the upper side surface and outer peripheral surface of the coil, so that there is a risk of increasing non-uniformization of temperature in the coil. However, the temperature can be uniformized by combining with the temperature keeping treatment, and hence the wrinkle-like shape defect is never promoted.

The chemical composition of the steel slab used in the grain-oriented electrical steel sheet according to embodiments of the invention will be explained below.

The steel slab for the grain-oriented electrical steel sheet used in the invention may have the well-known chemical composition, and may or may not contain an inhibitor-forming element for causing secondary recrystallization.

For example, when an inhibitor is utilized, the steel slab may contain proper amounts of Al and N in case of using AlN series inhibitor or Mn and Se and/or S in case of using MnS/MnSe series inhibitor. Of course, both inhibitor series can be used in combination. When the inhibitor is used, it is preferable that the concrete amounts of Al, N, S and Se added are Al: 0.01-0.065 mass %, N: 0.005-0.012 mass %, S: 0.005-0.03 mass %, and Se: 0.005-0.03 mass %, respectively.

On the other hand, when the inhibitor is not used, it is necessary to restrict the contents of Al, N, S and Se. Concretely, Al, N, S and Se are preferably limited to Al: not more than 0.0100 mass %, N: not more than 0.0050 mass %, S: not more than 0.0050 mass %, and Se: not more than 0.0050 mass %, respectively.

The basic ingredients other than the above inhibitor of the steel slab used in embodiments of the invention will be explained below.

C: not more than 0.15 mass %

C is preferable to be contained for improving the texture of the hot rolled steel sheet. However, if C content exceeds 0.15 mass %, it is difficult to reduce the C content to not more than 0.0050 mass % not causing magnetic aging during the decarburization annealing in the production process. Therefore, the C content is preferable to be not more than 0.15 mass %. More preferably, it is not more than 0.10 mass %. Moreover, the lower limit of C content is not particularly limited because the secondary recrystallization can be conducted even in the material not including C.

Si: 2.0-8.0 mass %

Si is an element effective for enhancing the electrical resistance of steel and reducing iron loss. In order to obtain an effect of reducing iron loss sufficiently, it is preferable to be contained in an amount of not less than 2.0 mass %. On the other hand, when the addition amount exceeds 8.0 mass %, the magnetic flux density is deteriorated, but also the capability of being rolled is remarkably deteriorated and the production becomes difficult. Therefore, Si is preferable to be within a range of 2.0 to 8.0 mass %. More preferably, it is in a range of 2.8 to 4.0 mass %.

Mn: 0.005-1.0 mass %

Mn is an element required for improving the hot workability, and is preferable to be added in an amount of not less than 0.005 mass %. On the other hand, the addition exceeding 1.0 mass % deteriorates the magnetic flux density. Therefore, Mn is preferable to be within a range of 0.005 to 1.0 mass %. More preferably, it is in a range of 0.03 to 0.3 mass %.

In addition to the above-described inhibitor-forming element and basic ingredients, arbitrary ingredients capable of properly adding for improving the magnetic properties will be described below.

Ni: 0.03-1.50 mass %

Ni is an element useful for improving the texture of the hot rolled sheet to improve the magnetic properties. In order to obtain such an effect, it is preferable to be added in an amount of not less than 0.03 mass %. On the other hand, when the addition amount exceeds 1.50 mass %, the secondary recrystallization becomes unstable and there is a risk of deteriorating the magnetic properties instead. Thus, when Ni is added, it is preferable to be within a range of 0.03 to 1.50 mass %.

Sn: 0.01-1.50 mass %, Sb: 0.005-1.50 mass %, Cu: 0.03-3.0 mass %, P: 0.03-0.50 mass %, Mo: 0.005-0.10 mass %, and Cr: 0.03-1.50 mass %

Sn, Sb, Cu, P, Mo and Cr are elements useful for reinforcing the inhibitor and improving the magnetic properties. However, when the content of each of the above ingredients is less than the above lower limit, the effect of improving the magnetic properties is small, while when it exceeds the above upper limit, the development of secondary recrystallized grains are obstructed to deteriorate the magnetic properties. Therefore, it is preferable to contain one or more of Sn, Sb, Cu, P, Mo, and Cr in the above respective range.

Moreover, the remainder other than the above ingredients of the steel slab used in the invention is Fe and inevitable impurities. However, other ingredients can be contained within a range of not damaging the effect of the invention.

The method of producing a grain-oriented electrical steel sheet according to embodiments of the invention will be explained below.

The steel slab as a material for the grain-oriented electrical steel sheet according to the invention can be produced according to usual manner without limitation as long as it satisfies the above chemical composition.

Subsequently, the steel slab is commonly subjected to hot rolling after reheated to a given temperature. However, it may also be subjected to direct rolling, i.e., hot rolling immediately after casting without reheating. Also, in the case of a thin cast slab, hot rolling can be skipped, followed by the subsequent steps.

Thereafter, the hot rolled sheet obtained by hot rolling is subjected to a hot band annealing, if necessary. The hot band annealing is preferable to be conducted by making an annealing temperature to a range of 800 to 1200° C. in order to highly develop the Goss texture in the secondary recrystallization for the final annealing. When the annealing temperature is lower than 800° C., a band texture introduced by the hot rolling remains and it is difficult to obtain a primary recrystallization texture of uniformly-sized grains and hence the development of the secondary recrystallized grains is obstructed. While when the annealing temperature exceeds 1200° C., the grain size after the hot band annealing is coarsened and it is difficult to obtain a primary recrystallization texture of uniformly-sized grains likewise.

Then, the steel sheet after the hot rolling or hot band annealing is subjected to pickling and single cold rolling or two or more of cold rollings with an intermediate annealing therebetween to obtain a cold rolled sheet having a desired final thickness.

The cold rolled sheet with the final thickness is thereafter subjected to a primary recrystallization annealing.

In the production method of the invention, it is advantageous to conduct rapid heating at an average heating rate of not less than 80° C./sec in a temperature range of 500-700° C. in the course of the heating for the primary recrystallization annealing. By this rapid heating can be caused the secondary recrystallization in the final annealing at a lower temperature, so that the side distortion defect due to creep deformation can be significantly reduced. The average heating rate is preferably not less than 100° C./sec, and more preferably not less than 120° C./sec.

Moreover, the rapid heating may be conducted in the course of the heating for the primary recrystallization annealing as in the above experiment, but can be conducted in another heat treatment prior to the primary recrystallization annealing. In the latter case, the same effect can be obtained.

Further, the primary recrystallization annealing may be conducted under a wet hydrogen atmosphere also serving as decarburization.

The steel sheet after the primary recrystallization annealing is subsequently coated on its surface with an annealing separator and then wound in a coil.

When a forsterite film is formed on the surface of the steel sheet, it is preferable to use an annealing separator containing not less than 50 mass % of MgO. In contrast, when the forsterite film is not formed on the surface of the steel sheet, it is preferable to use an annealing separator containing $Al_2O_3$, $SiO_2$ or the like as a main ingredient.

Moreover, the steel sheet after the primary recrystallization annealing may be subjected to nitriding for the purpose of reinforcing the inhibitor effect before the start of the secondary recrystallization in the final annealing as described later.

The steel sheet (coil) coated with the annealing separator is thereafter subjected to a final annealing.

In the production method according to the invention, it is advantageous to conduct a temperature keeping treatment keeping the steel sheet for 2-100 hours within a temperature range of 700-1000° C. in the course of the heating for the final annealing. By conducting the temperature keeping treatment can be significantly reduced the edge wave defect or the wrinkle-like shape defect generated in the final annealing.

When the keeping temperature is lower than 700° C., even if the temperature distribution in the coil is uniformized by the temperature keeping treatment, the temperature distribution becomes non-uniform again in subsequent heating, so that the effect of reducing the shape defects is small. While, when the keeping temperature exceeds 1000° C., the effect of reducing the shape defects is small, because uneven sintering of the annealing separator MgO is generated up to the keeping temperature, and because the steel sheet is heated over 1000° C. while the discharge of hydration water is not sufficient. Preferably, the keeping temperature is in a range of 800 to 950° C.

Also, when the temperature keeping time is less than 2 hours, it is not sufficient to uniformize the temperature distribution in the coil, while when it exceeds 100 hours, thermal load to the coil is too large and the creep deformation is increased to raise the side distortion defect rate. Moreover, the lower limit of the keeping time is preferably 3 hours, more preferably 5 hours. While, the upper limit of the keeping time is 80 hours, more preferably 60 hours.

In the production method according to embodiments of the invention, the final annealing is conducted while the coil is placed on the upper surface of the coil supporting stand in the annealing furnace with an upended state. In this case, it is important to lay the thermal insulation material on the upper surface of the coil supporting stand in order to further improve the shape defects. By combining the laying of the thermal insulation material with the aforementioned rapid heating in the course of the heating for the primary recrystallization annealing and the temperature keeping treatment in the course of the heating for the final annealing can be further reduced the side distortion defect without deteriorating the edge wave defect or the wrinkle-like shape defect.

Since the main object of laying the thermal insulation material is to reduce the side distortion defect as mentioned above, it is preferable to lay the thermal insulation material on the upper surface of the coil supporting stand concentrically from the outer periphery thereof. Also, it is preferable that the area of the thermal insulation material laid on the upper surface of the coil supporting stand is not less than 20% with respect to the radius of the coil supporting stand. When the laying area is less than 20%, the effect of reducing the side distortion defect cannot be fully obtained. It is more preferably not less than 30%, further preferably not less than 40%. However, the upper limit is preferable to be approximately 80% from the viewpoint of reducing the cost for the thermal insulation material.

The thermal insulation material used in the invention is not particularly limited, and may be used from the well-known materials. For example, ceramic fiber such as $Al_2O_3$, $SiO_2$, MgO or the like can be preferably used. Further, the thickness of the thermal insulation material is sufficient to be 5 mm or more unless the coil contacts with the coil supporting stand directly. However, when it is too thick, a level difference is generated on the upper surface of the coil supporting stand to cause new shape defects, so that the upper limit is preferable to be approximately 40 mm.

In the final annealing, there are a case where the coil is placed directly on the coil supporting stand and a case where a disk-shaped spacer made of stainless or cast steel is inserted between the coil and the coil supporting stand. In the former case, the thermal insulation material is laid between the coil and the coil supporting stand. In the latter case, it may be laid either between the spacer and the coil or between the spacer and the coil supporting stand.

Then, the steel sheet after the final annealing is subjected to application of an insulation coating and baking, or to flattening annealing also serving as baking and shape correcting to thereby obtain a product sheet. The type of the insulation coating and the flattening annealing conditions are not particularly limited as long as the treatment is conducted according to the usual manner.

EXAMPLE

A steel slab comprising C: 0.07 mass %, Si: 3.3 mass %, Mn: 0.06 mass %, Al: 0.006 mass %, N: 0.003 mass %, Sb: 0.003 mass % and the remainder being Fe and inevitable impurities is produced by continuous casting. Then, the slab is heated to 1200° C. and hot rolled to form a hot rolled sheet having a thickness of 2.6 mm, which is subjected to a hot band annealing at 1000° C. Next, the hot rolled sheet is cold rolled to obtain a cold rolled sheet having a final thickness of 0.27 mm.

Then the cold rolled sheet is subjected to a heat treatment by rapidly heating to 700° C. at a heating rate of 100° C./sec from 500° C. to 700° C. and cooling, and thereafter subjected to primary recrystallization annealing also serving as decarburization at a temperature of 825° C. Here, the heating rate from 500° C. to 700° C. in the primary recrystallization annealing is 30° C./sec. By way of comparison, the cold rolled sheet is only subjected to the primary recrystallization annealing also serving as decarburization without the heat treatment conducting the rapid heating.

Thereafter, the steel sheet subjected to the primary recrystallization annealing is coated on its surface with a slurry of an annealing separator prepared by adding 5 parts by mass of $TiO_2$ to 100 parts by mass of MgO, dried, wounded in a coil and placed on an upper surface of a coil supporting stand in a batch type annealing furnace with an upended state. In this case, a thermal insulation material is laid on the upper surface of the coil supporting stand so as to cover 20% of the surface with respect to the radius of the coil supporting stand concentrically from the outer periphery thereof. As the thermal insulation material is used $Al_2O_3$—$SiO_2$ based ceramic fiber having a thickness of 10 mm.

Thereafter, the steel sheet is subjected to a temperature keeping treatment keeping the sheet for 1-150 hours between from 500° C. to 1100° C. during the heating process as shown in Table 1 and further to a final annealing also serving as secondary recrystallization annealing and purification annealing by heating up to 1200° C. and soaking for 10 hours. Subsequently, the sheet is coated with a tension coating liquid and subjected to a flattening annealing at 830° C. also serving as baking of the tension coating and shape correction to obtain a product coil.

In this case, the shape of the product coil is visually observed to measure a shape defect rate in each production condition ((defect length/full coil length)×100(%)).

The results measured on the shape defect rate are also shown in Table 1. As seen from these results, the shape defect rate is significantly lowered in the steel sheets subjected to the heat treatment conducted by the rapid heating before the primary recrystallization annealing and to the temperature keeping treatment in the proper range in the course of the heating for the final annealing.

TABLE 1

| | Presence or absence of heat treatment | Temperature keeping treatment in final annealing | | | |
|---|---|---|---|---|---|
| No. | conducted by rapid heating | Keeping temperature(° C.) | Keeping time (hr) | Shape defect rate (%) | Remarks |
| 1 | Presence | 500 | 10 | 4.5 | Comparative Example |
| 2 | Presence | 700 | 10 | 2.8 | Invention Example |
| 3 | Presence | 800 | 10 | 1.6 | Invention Example |
| 4 | Presence | 1000 | 10 | 2.1 | Invention Example |
| 5 | Presence | 1100 | 10 | 6.2 | Comparative Example |
| 6 | Presence | 800 | 1 | 4.1 | Comparative Example |
| 7 | Presence | 800 | 150 | 5.2 | Comparative Example |
| 8 | Absence | 500 | 10 | 11.8 | Comparative Example |
| 9 | Absence | 700 | 10 | 10.4 | Comparative Example |
| 10 | Absence | 800 | 10 | 8.1 | Comparative Example |
| 11 | Absence | 1000 | 10 | 9.8 | Comparative Example |
| 12 | Absence | 1100 | 10 | 13.4 | Comparative Example |
| 13 | Absence | 800 | 1 | 13.6 | Comparative Example |

TABLE 1-continued

| No. | Presence or absence of heat treatment conducted by rapid heating | Temperature keeping treatment in final annealing Keeping temperature(° C.) | Keeping time (hr) | Shape defect rate (%) | Remarks |
|---|---|---|---|---|---|
| 14 | Absence | 800 | 150 | 14.9 | Comparative Example |

The invention claimed is:

1. A method of producing a grain-oriented electrical steel sheet having forsterite film by subjecting a coil for grain-oriented electrical steel sheet after cold rolling to a primary recrystallization annealing, applying an annealing separation agent composed mainly of MgO thereon, and conducting final annealing, wherein for the primary recrystallization annealing rapid heating is conducted at a rate of not less than 80° C./sec from 500° C. to 700° C., and for the final annealing a temperature keeping treatment is conducted for 2 to 100 hours by maintaining a constant keeping temperature from 700° C. to 1000° C. and subsequently the temperature is raised up to 1180° C. or more and then kept at a constant temperature, and wherein the shape defect rate is 2.8% or less.

2. The method of producing a grain-oriented electrical steel sheet according to claim 1, wherein the final annealing is conducted by laying a thermal insulation material on an upper surface of a coil supporting stand in an annealing furnace used for the final annealing concentrically from the outer periphery of the coil supporting stand and over an area of 20-80% of the radius of the coil supporting stand.

3. The method of producing a grain-oriented electrical steel sheet according to claim 1, wherein the rapid heating in the primary recrystallization annealing is conducted by another heat treatment preceding the primary recrystallization annealing.

4. The method of producing a grain-oriented electrical steel sheet according to claim 2, wherein the rapid heating in the primary recrystallization annealing is conducted by another heat treatment preceding the primary recrystallization annealing.

* * * * *